US007660672B2

(12) United States Patent
Tan et al.

(10) Patent No.: US 7,660,672 B2
(45) Date of Patent: Feb. 9, 2010

(54) METHOD AND COMPUTER PROGRAM PRODUCT FOR DRILLING MUD DESIGN OPTIMIZATION TO MAINTAIN TIME-DEPENDENT STABILITY OF ARGILLACEOUS FORMATIONS

(75) Inventors: Chee Phuat Tan, Kuala Lumpur (MY); Magdalena Povstyanova, Ashgabat (TM)

(73) Assignee: Schlumberger Technology Corporation, Houston, TX (US)

( * ) Notice: Subject to any disclaimer, the term of this patent is extended or adjusted under 35 U.S.C. 154(b) by 132 days.

(21) Appl. No.: 12/026,423

(22) Filed: Feb. 5, 2008

(65) Prior Publication Data

US 2008/0190190 A1 Aug. 14, 2008

Related U.S. Application Data

(60) Provisional application No. 60/899,876, filed on Feb. 7, 2007.

(51) Int. Cl.
*G01V 1/40* (2006.01)

(52) U.S. Cl. ..... 702/6; 175/40; 175/48; 175/50; 175/58; 175/59; 175/60; 175/65; 175/70; 175/72; 702/9; 702/12

(58) Field of Classification Search ..... 702/6–13
See application file for complete search history.

(56) References Cited

U.S. PATENT DOCUMENTS

| | | | | |
|---|---|---|---|---|
| 2,938,708 | A | 5/1960 | Arps | |
| 3,841,419 | A | 10/1974 | Russell | |
| 4,710,906 | A * | 12/1987 | Bradley et al. | 367/35 |
| 5,285,692 | A * | 2/1994 | Steiger et al. | 73/866 |
| 2003/0212495 | A1 * | 11/2003 | Mese et al. | 702/9 |

FOREIGN PATENT DOCUMENTS

| | | | |
|---|---|---|---|
| AU | 41696 72 | A | 11/1973 |
| WO | WO-2006/007347 | A | 1/2006 |

* cited by examiner

*Primary Examiner*—Carol S Tsai
*Assistant Examiner*—Ronald L Biegel

(57) ABSTRACT

A method and computer program product of either preventing or minimizing pore pressure increase near the wellbore wall within argillaceous formations through which a borehole has been drilled. By interpreting relevant drilling experience data, the type, extent and time-dependency of wellbore instability mechanisms are determined. The impact of drilling mud designs on the time-dependent wellbore instability and hole enlargement is determined by back-analyzing observed drilling events. At least one field-based criterion relationship between net mud weight reduction percentage ratio and hole enlargement is determined. A maximum allowable percentage ratio(s) of net mud weight reduction and either breakout mud weight or mud weight used for the adopted maximum hole enlargement that the wellbore may experience during drilling is determined. Drilling mud salinity value and salt type to satisfy maximum allowable percentage ratio(s) is then determined.

20 Claims, 4 Drawing Sheets

METHOD AND COMPUTER PROGRAM PRODUCT FOR DRILLING MUD DESIGN OPTIMIZATION TO MAINTAIN TIME-DEPENDENT STABILITY OF ARGILLACEOUS FORMATIONS

RELATED APPLICATIONS

This patent application claims priority of U.S. Provisional Application No. 60/899,876, filed Feb. 7, 2007, the disclosures of which are each hereby incorporated herein by reference in their entireties.

FIELD OF THE INVENTION

This invention relates to a field-based method and computer program product for calculating drilling mud salinity and selecting salt type for water-based, synthetic-based and oil-based drilling muds to either prevent or minimize pore pressure increase near the wellbore wall inside argillaceous formations during overbalanced drilling, which could otherwise lead to time-dependent wellbore instability in the formations through which a borehole has been drilled. The method and computer program product may utilize a range of petrophysical and chemical properties of the formations and properties of the drilling mud, which may be obtained from either laboratory measurements and/or property correlations and database. The method incorporates a process for rigorous calibration of the drilling mud-argillaceous formation interaction models based on field drilling experience and observations of offset wells. The calibrated models are subsequently used to develop optimum drilling mud designs to maintain time-dependent stability of the argillaceous formations in future wells.

BACKGROUND OF THE INVENTION

Argillaceous formations account for about 75% of drilled sections in oil, gas and geothermal subterranean wells and cause approximately 90% of wellbore instability-related problems during the drilling operations. The formations, including shales, mudstones, siltstones and claystones, are of a fine-grained nature and low permeability but yet are fairly porous and normally saturated with formation water. The combination of these characteristics results in the formations being highly susceptible to time-dependent effective mud support change, which is a function of the difference between the mud (wellbore) pressure and pore fluid (formation) pressure.

When drilling under an overbalanced condition in argillaceous formations without an effective flow barrier present at the wellbore wall, mud pressure will penetrate progressively into the formation. Without an isolation (impermeable) membrane on the wall, an effective barrier will not be formed due to the low permeability of the formation. The low filtration rate will result in negligible deposition of drilling mud solids on the wellbore wall and any solid deposition will be eroded by the hydrodynamics of the drilling mud. Due to the saturation and low permeability of the formation, penetration of a small volume of mud filtrate into the formation results in a considerable increase in pore pressure near the wellbore wall. The increase in pore pressure reduces the effective mud support, which leads to a less stable wellbore condition.

The fine pores and negative clay charges on pore surfaces make argillaceous formations exhibit membrane behavior. Hence the flow of water out of (or into) such materials due to the chemical potential mechanism is somewhat similar to the flow of water through a semi-permeable membrane. The driving force involved in the water transportation (for zero overbalance conditions) is the chemical potential gradient across the membrane, which is generally related to the difference in solute (salt) concentration i.e., water activity. With the water activity of the drilling mud being lower than the formation activity, an osmotic outflow of pore fluid from the formation will reduce the pore pressure in the formation. If the osmotic outflow is greater than the inflow due to the hydraulic gradient (mud pressure penetration), there will be a net flow of water out of the formation into the wellbore. This will result in lowering of the pore pressure below the in-situ value and dehydration of the formation. The associated increase in the effective mud support and formation strength will lead to an improvement in the stability of the wellbore. For an ideal semi-permeable membrane, all solutes are reflected by the membrane and only water molecules can pass through the membrane. However, argillaceous materials exhibit a non-ideal semi-permeable ('leaky') membrane behavior to water-based solutions because they have a range of pore sizes including wide pore throats, which result in significant permeability to solutes. The wide throats reduce the solute interaction with the pore surfaces, which increase the permeability of the membrane to solutes. The solutes transferred across the membrane system will reduce the chemical potential (water activity) of the pore fluid. This will gradually reduce the chemical potential difference between the drilling mud and the formation, and consequently result in a reduction in the effective mud support.

Two parameters that can be manipulated to increase the osmotic outflow of pore fluid are salt type and concentration, and by membrane efficiency. The membrane efficiency is a measure of the capacity of the membrane to sustain osmotic pressure between the drilling mud and argillaceous formation. The osmotic outflow increases, with increase in salt concentration and membrane efficiency. The membrane efficiency generated by water-based drilling mud can be increased by partially plugging the pores with mud additives, which will restrict the movement of salts between the drilling mud and the formation.

It is worth noting that oil-based and synthetic-based drilling muds generate a highly efficient membrane through their water-in-oil emulsion, i.e., independently of the formation. As a result, the stability of wells drilled in argillaceous formations with oil-based and synthetic-based drilling muds can be greatly enhanced. However, incorrect salinity within the water phase of the drilling mud may still result in time-dependent wellbore instability in argillaceous formations.

Hence, there is a need for a field-based pragmatic method and computer program product for calculating drilling mud salinity and selecting salt type for water-based, synthetic-based and oil-based drilling muds to either prevent or minimize pore pressure increase near the wellbore wall inside argillaceous formations during overbalanced drilling, which could otherwise lead to time-dependent wellbore instability in the formations through which a borehole has been drilled.

SUMMARY OF THE INVENTION

The present invention relates to a field-based method and computer program product for calculating drilling mud salinity and selecting salt type for water-based, synthetic-based and oil-based drilling muds to maintain time-dependent wellbore instability in argillaceous formations through which a borehole has been drilled by either managing or preventing pore pressure increase near the wellbore wall inside the formations during overbalanced drilling.

One embodiment of the invention incorporates back-analysis on observed time-dependent wellbore instability events in argillaceous formations. For each of the observed events, pore pressure change near the wellbore wall due to mud pressure penetration and chemical potential mechanisms are determined. The determination requires a range of petrophysical and chemical properties of the argillaceous formations and properties of the drilling mud, which may be obtained from either laboratory measurements and/or property correlations and database. The impact of the time-dependent pore pressure change near the wellbore wall on wellbore stability of the formations may be evaluated using field-based pragmatic criteria based on the results of the back-analysis of the time-dependent events. The evaluation will subsequently enable optimum drilling mud design, whereby the mud pressure penetration mechanism is fully counteracted by the chemical potential mechanism, to be developed for the argillaceous formations in future wells.

If an optimum drilling mud design is not feasible, there will be reduction in effective mud support (overbalance gradient) with time in the formations. The daily reduction in effective mud support may also be used as a criterion for managing time-dependent wellbore instability in argillaceous formations. The mud weight may need to be increased progressively by the total reduction in effective mud support prior to the next pull out of hole, e.g., wiper trip, so as to replenish the mud support reduction with time.

According to one aspect of the invention, there is provided a method of either preventing or minimizing pore pressure increase near the wellbore wall within argillaceous formations through which a borehole has been drilled. By interpreting relevant drilling experience data, the type, extent and time-dependency of the wellbore instability mechanisms are determined. The impact of drilling mud designs on the time-dependent wellbore instability and hole enlargement is determined by back-analyzing the observed drilling events. This involve determining pore pressure change near the wellbore wall after maximum exposure duration due to mud pressure penetration mechanism and chemical potential mechanism. At least one field-based criterion relationship between net mud weight reduction percentage ratio and hole enlargement is determined. A maximum allowable percentage ratio(s) of net mud weight reduction and either breakout mud weight or mud weight used for the adopted maximum hole enlargement that the wellbore may experience during drilling is determined. Drilling mud salinity and salt type to satisfy the maximum allowable percentage ratio(s) is then determined.

According to another aspect of the invention, there is provided a computer program product embodied in computer readable medium, for either preventing or minimizing pore pressure increase near the wellbore wall within argillaceous formations through which a borehole has been drilled. By interpreting relevant drilling experience data, the type, extent and time-dependency of the wellbore instability mechanisms are determined. The impact of drilling mud designs on the time-dependent wellbore instability and hole enlargement is determined by back-analyzing the observed drilling events. This involve determining pore pressure change near the wellbore wall after maximum exposure duration due to mud pressure penetration mechanism and chemical potential mechanism. At least one field-based criterion relationship between net mud weight reduction percentage ratio and hole enlargement is determined. A maximum allowable percentage ratio(s) of net mud weight reduction and either breakout mud weight or mud weight used for the adopted maximum hole enlargement that the wellbore may experience during drilling is determined. Drilling mud salinity and salt type to satisfy the maximum allowable percentage ratio(s) is then determined.

BRIEF DESCRIPTION OF THE DRAWINGS

A more complete appreciation of the present invention and many of the advantages thereof will be more readily understood by reference to the following description when considered in conjunction with the accompanying drawings in which.

DETAILED DESCRIPTION OF THE PREFERRED EMBODIMENTS

Figure 1:
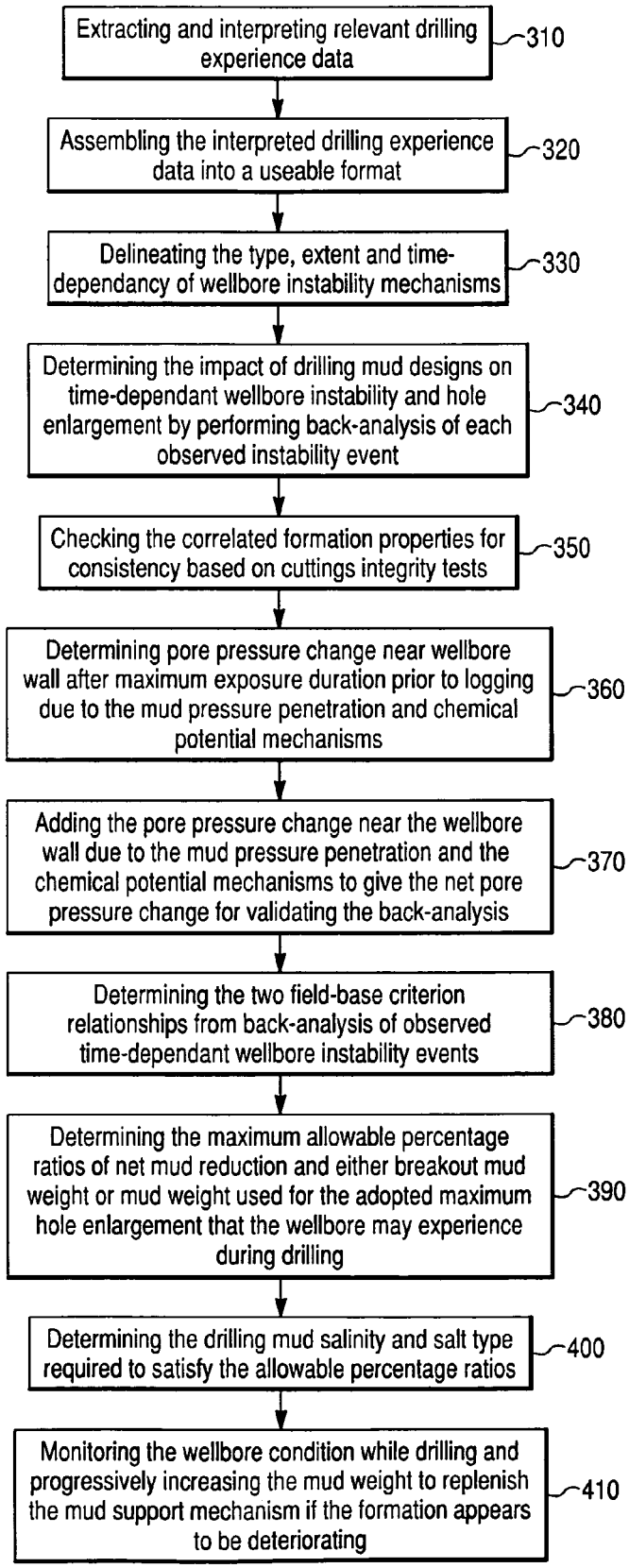
FIG. 1 is a flow diagram showing various steps performed in the first embodiment of the invention.

The invention is described below with reference to the drawings. These drawings illustrate certain details of specific embodiments that implement the method and computer program product of the present invention. However, describing the invention with drawings should not be construed as imposing on the invention any limitations that may be present in the drawings. The present invention contemplates method and computer program product on any machine-readable media for accomplishing its operations. The embodiments of the present invention may be implemented using an existing computer processor, or by a special purpose computer processor incorporated for this or another purpose, or by a hard-wired system.

As noted above, embodiments within the scope of the present invention include computer program product comprising machine-readable media for carrying or having machine-executable instructions or data structures stored thereon. Such machine-readable media can be any available media, which can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium that can be used to carry or store desired program code in the form of machine-executable instructions or data structures and that can be accessed by a general purpose or special purpose computer or other machine with a processor. When information is transferred or provided over a network or another communication connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data, which cause a general purpose computer, special purpose computer, or special purpose processing machines to perform a certain function or group of functions.

Embodiments of the invention will be described in the general context of method steps that may be implemented in one embodiment by a program product including machine-executable instructions, such as program code, for example in the form of program modules executed by machines in networked environments. Generally, program modules include routines, programs, objects, components, data structures, etc. that perform particular tasks or implement particular abstract data types. Machine-executable instructions, associated data structures, and program modules represent examples of program code for executing steps of the method disclosed herein. The particular sequence of such executable instructions or associated data structures represent examples of corresponding acts for implementing the functions described in such steps.

Embodiments of the present invention may be practiced in a networked environment using logical connections to one or more remote computers having processors. Logical connections may include a local area network (LAN) and a wide area network (WAN) that are presented here by way of example and not limitation. Such networking environments are commonplace in office-wide or enterprise-wide computer networks, intranets and the internet and may use a wide variety of different communication protocols. Those skilled in the art will appreciate that such network computing environments will typically encompass many types of computer system configuration, including personal computers, hand-held devices, multi-processor systems, microprocessor-based or programmable consumer electronics, network PCs, minicomputers, mainframe computers, and the like. Embodiments of the invention may also be practiced in distributed computing environments where tasks are performed by local and remote processing devices that are linked (either by hardwired links, wireless links, or by a combination of hardwired or wireless links) through a communication network. In a distributed computing environment, program modules may be located in both local and remote memory storage devices.

An exemplary system for implementing the overall or portions of the invention might include a general purpose computing device in the form of a computer, including a processing unit, a system memory, and a system bus, that couples various system components including the system memory to the processing unit. The system memory may include read only memory (ROM) and random access memory (RAM). The computer may also include a magnetic hard disk drive for reading from and writing to a magnetic hard disk, a magnetic disk drive for reading from or writing to a removable magnetic disk, and an optical disk drive for reading from or writing to a removable optical disk such as a CD-ROM or other optical media. The drives and their associated machine-readable media provide nonvolatile storage of machine-executable instructions, data structures, program modules and other data for the computer.

A first embodiment of the invention will be described in detail herein below, whereby the steps of a method according to the first embodiment are shown in FIG. 1. In order to avoid time-dependent wellbore instability in argillaceous formations, the water activity of the drilling mud needs to be sufficiently low (i.e. has sufficiently high salt concentration) to induce the required osmotic outflow from the formation (chemical potential mechanism) to counteract the pore pressure increase near the wellbore wall due to mud pressure penetration mechanism. However, the use of excessively high salt concentration could be detrimental to the formation by over-dehydrating and weakening the formation through the generation of micro-fractures. This could negate the stabilization of the formation by the chemical potential mechanism leading to time-dependent wellbore instability.

Figure 2:
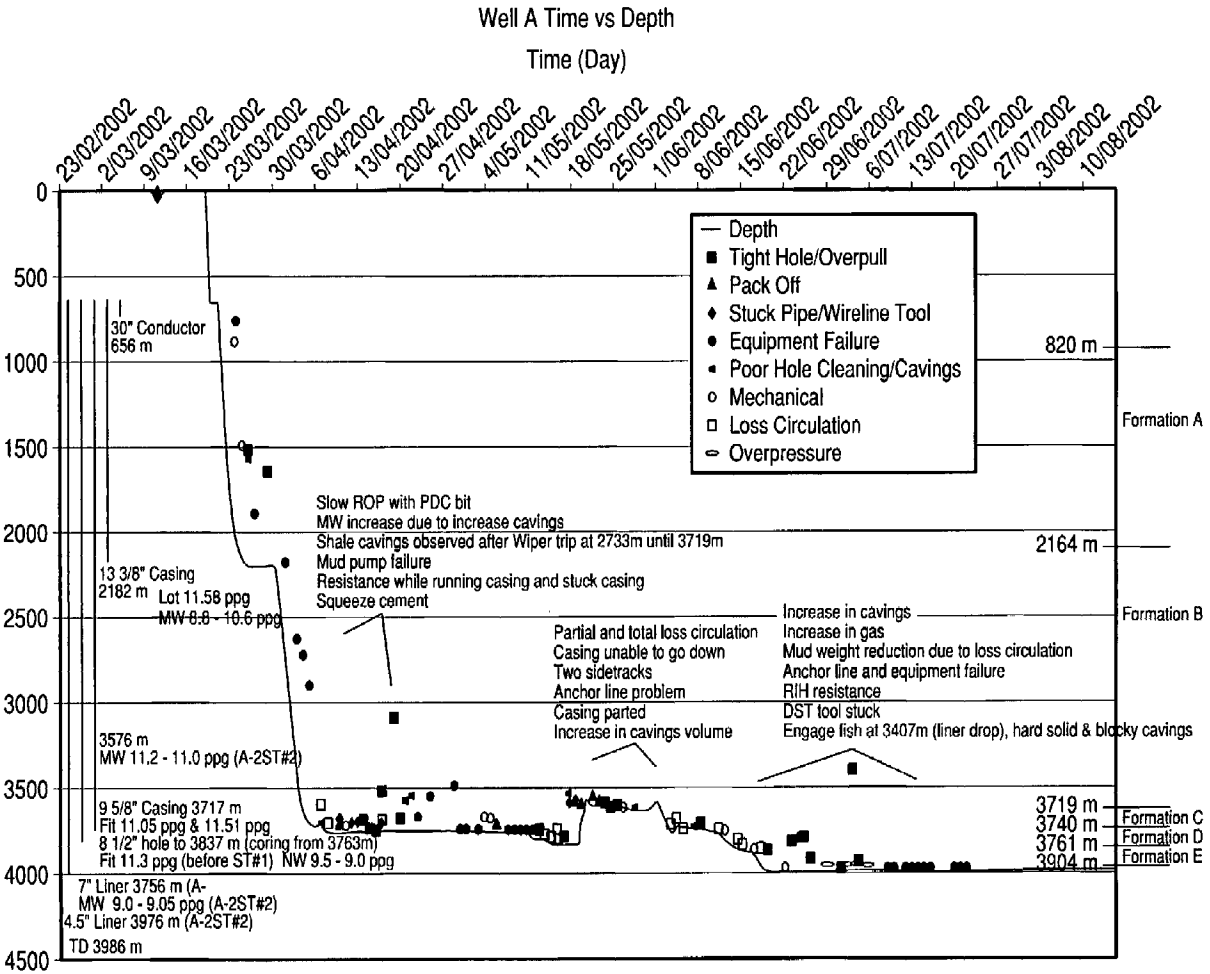
Fig. 2 Prior Art
FIG. 2 shows an example of a drilling summary plot.

Accordingly, the first embodiment includes a first step 310 of obtaining, extracting and interpreting relevant drilling experience data, including those possibly related to wellbore instability, of offset wells, whereby such data can be obtained from well completion, daily drilling and/or daily mud reports, for example. Relevant drilling information and drilling experience data include, but not limited to, the following:

Formation top
Hole size
Mud weight
Casing or liner
Leak-off test or formation integrity test
Coring
Logging
Interval of reaming
Interval of tight hole
Interval where overpull was encountered
Wiper trip
Excessive circulation duration
Unscheduled mud conditioning
Flow check for mud weight
Hole cleaning
Heavy cutting load
Cavings circulated out
Cavings shape
Drilling break
Packing off
Stuck pipe, casing, liner etc.
Stood up casing, liner, logging tool etc.
Severance/parting of drill pipe etc.
Fishing
Rate of penetration
Drilling delay
Undergauge hole
Bit balling
Mud loss
Well ballooning
Overpressure
Kick
Background gas
Connection gas
Equipment failure The interpretation of the drilling experience data is performed to ensure that the data is either mechanical wellbore stability-related, drilling fluid-shale interaction-related, and/or relevant to geomechanical processes, analyses and applications. The first embodiment includes a second step 320 of assembling the interpreted drilling experience data into a readily useable format, such as, for example, in the form of a drilling summary plot. There can be various forms of drilling summary plot and an example of such a plot is shown in FIG. 2. The first embodiment then includes a third step 330 of assessing the plot together with borehole image data (e.g., visual images of the borehole taken over a period of time), caliper and composite logs, to delineate the type, extent and time-dependency of wellbore instability mechanisms. The occurrence of time-dependent wellbore instability is thereby represented by a delay between drilling (exposure) of a section and onset of wellbore instability-related problems.

The first embodiment then includes a fourth step 340 of assessing the drilling experience data and hole condition of the wells data, to determine the impact of drilling mud designs (weight and salinity) on time-dependent wellbore instability and hole enlargement. For each of the observed time-dependent instability event, pore pressure change near the wellbore wall due to mud pressure penetration and chemical potential mechanisms are determined by performing a back-analysis of the instability event. The determination utilizes a range of petrophysical and chemical properties of the argillaceous formations and properties of the drilling mud, which may be obtained from either laboratory measurements and/or property correlations, and/or with property information stored in a database. The formation properties include, but not limited to, rock water activity, pore water composition, pore water activity, membrane efficiency, pore size distribution, porosity, permeability and mineralogical composition. The drilling mud properties include, but not limited to, mud water activity, and mud filtrate kinematic viscosity and adhesion.

The first embodiment further includes a fifth step 350 of checking the correlated formation properties for consistency, in particular formation activity, based on properly designed and conducted cuttings integrity tests. The cuttings integrity tests may be conducted with an adequate range of drilling mud salinities (activities), which are below and above the correlated formation activity. Based on the percentage recovery, and morphology and angularity of the hot-rolled cuttings for the range of drilling mud salinities, the formation activity may be estimated and cross-checked with the correlated value. For example, TABLE 1 shows the percentage recovery of cuttings integrity tests conducted with drilling mud salinities of between 0.926 and 0.965. Based on the test results, the formation activity may be estimated to be between 0.937 and 0.954 (~0.946).

TABLE 1

| Drilling Mud Sample | KCl Concentration (wt %) | Measured Mud Activity | Percentage Recovery (%) |
|---|---|---|---|
| Silicate Mud | 5 | 0.965 | 84.95 |
| | 8.5 | 0.954 | 98.09 |
| | 11.5 | 0.937 | 104.23 |
| | 14 | 0.926 | 100.37 |

In the first embodiment, a sixth step 360 includes determining the pore pressure change near the wellbore wall after maximum exposure duration prior to logging due to the mud pressure penetration mechanism and chemical potential mechanism. The pore pressure change near the wellbore wall due to mud pressure penetration is dependent on a range of parameters including, but not limited to, overbalance pressure, formation permeability, pore size distribution and porosity, and drilling mud filtrate kinematic viscosity and adhesion. The pore pressure change near the wellbore wall due to chemical potential mechanism is dependent on a range of parameters including, but not limited to, formation water activity, pore water composition, pore water activity, membrane efficiency, pore size distribution, porosity, permeability and mineralogical composition, and drilling mud water activity. The pore pressure change due to these two mechanisms, determined according to techniques known in the art, are added together to provide the net pore pressure change for validating the back-analysis, in a seventh step 370.

The effective mud weight i.e., effective mud support on the wellbore wall, is given by the difference between mud weight and formation pressure gradient. The increase in pore pressure near the wellbore wall with time results in a reduction in the effective mud weight (support). This leads to a less stable wellbore condition, which may eventually lead to wellbore instability after a critical exposure duration.

Provided below are two field-based criteria that can be used in the first embodiment for calculating drilling mud salinity and selecting salt type for maintaining time-dependent wellbore stability in argillaceous formations:

Criterion 1: Variation of hole enlargement with percentage ratio of net mud weight reduction and breakout mud weight Criterion 2: Variation of hole enlargement with percentage ratio of net mud weight reduction and mud weight used The net mud weight reduction is defined as the total pore pressure change near the wellbore wall minus the difference between mud weight used and breakout mud weight (mud weight to prevent breakout shear failure). If the mud weight used is higher than the breakout mud weight, the difference will provide a "buffer" for the pore pressure increase. In essence, the pore pressure can increase by up to the difference before any time-dependent wellbore instability will set in.

Figure 3:
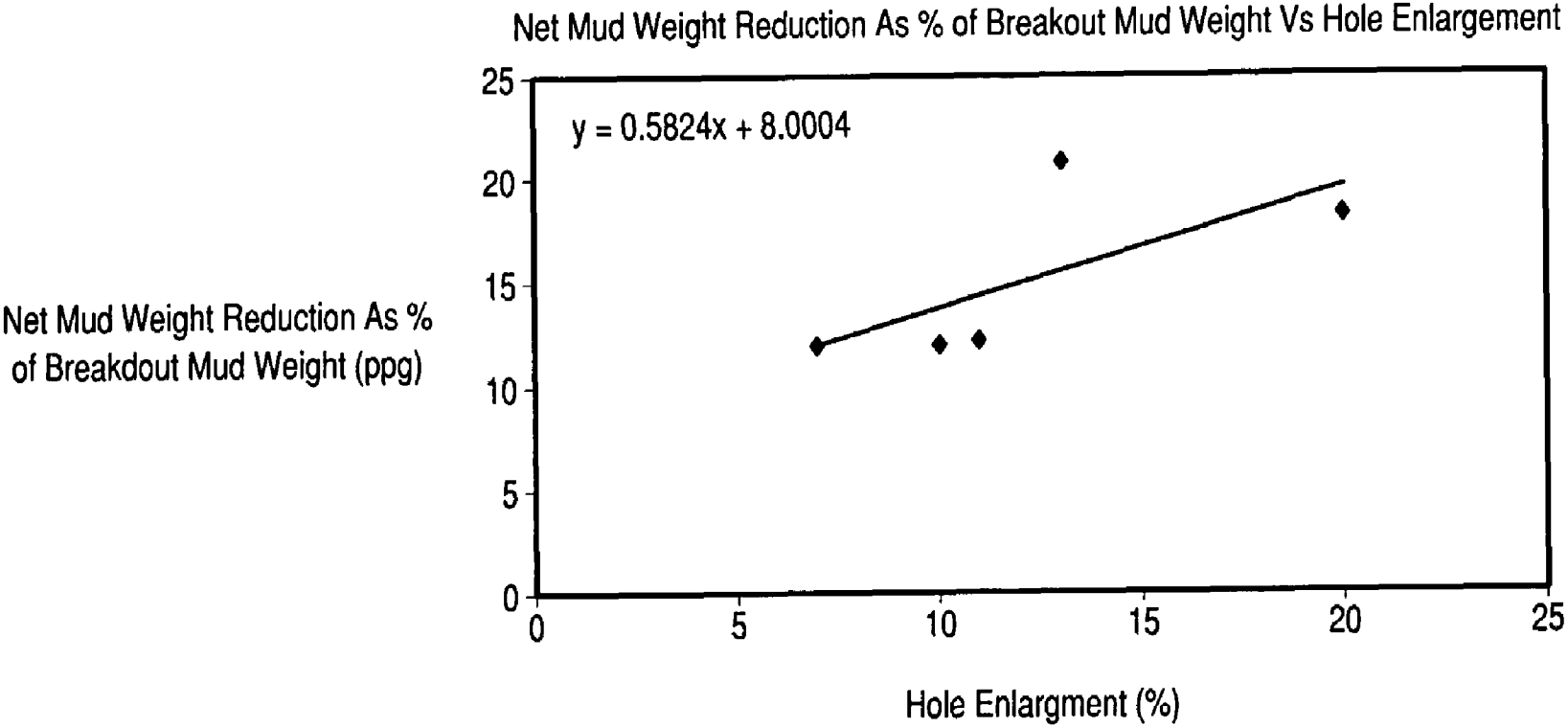
FIG. 3 shows variation of hole enlargement with net mud weight reduction as percentage of breakout mud weight.
Figure 4:
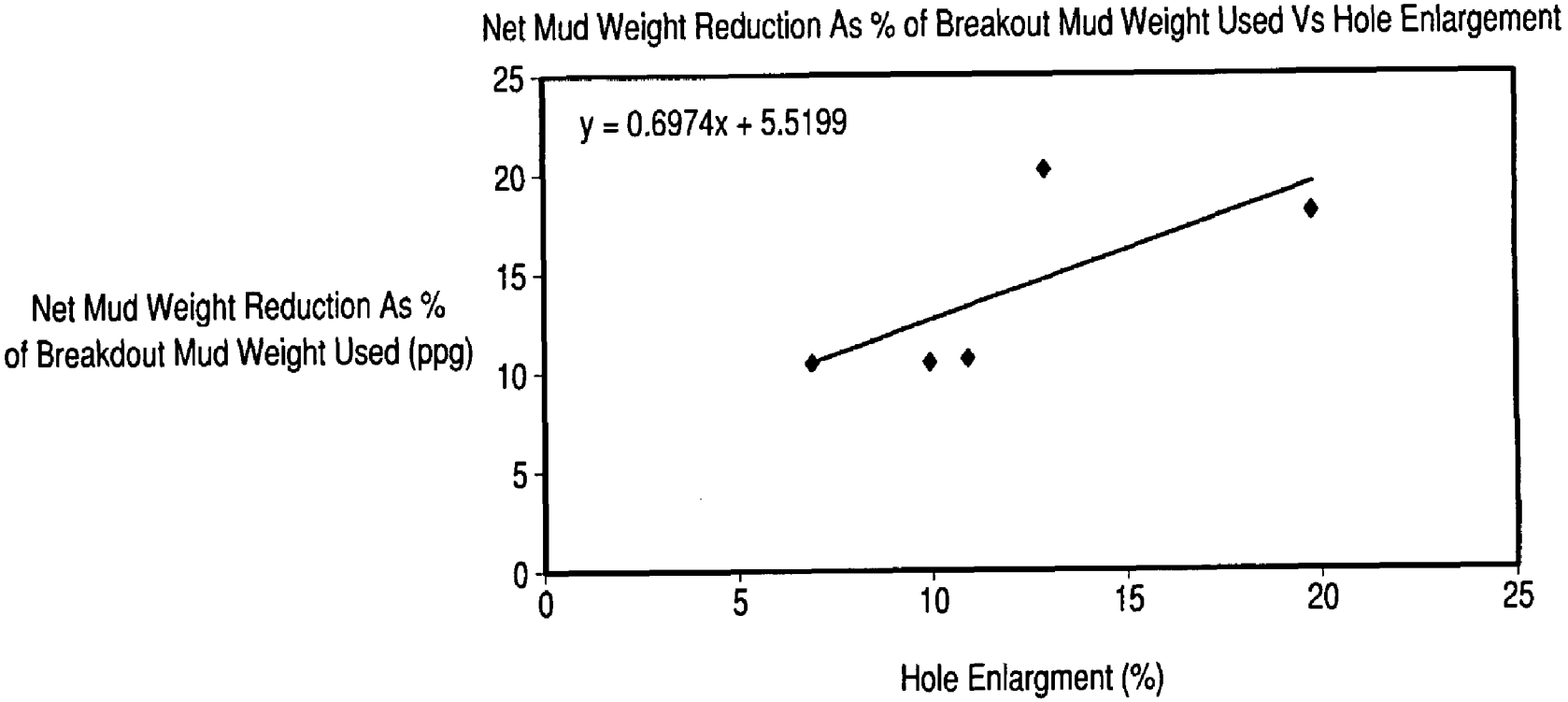
FIG. 4 shows variation of hole enlargement with net mud weight reduction as percentage of mud weight used.

The relationships for Criterion 1 and Criterion 2 may be determined from the back-analysis of the observed time-dependent wellbore instability events, in an eighth step 380 of the first embodiment. TABLE 2 summarizes an example of the back-analysis of time-dependent wellbore instability events in an argillaceous formation. The back-analysis results for Criterion 1 and Criterion 2 of the example are shown in FIG. 3 and FIG. 4, respectively. Correlation equations may be determined for the back-analysis data by regressional analysis as given by the equations shown on the top right hand corner of the plots. It can be seen that, as would be expected, a larger net mud weight reduction will result in larger hole enlargement. Based on the correlation equations shown on the plots, the maximum allowable percentage ratios of net mud weight reduction and either breakout mud weight or mud weight used can be determined for the adopted maximum hole enlargement that the wellbore may experience during drilling, in a ninth step 390. The drilling mud salinity and salt type required to satisfy the allowable percentage ratios are subsequently determined from the corresponding pore pressure change near the wellbore wall due to the chemical potential mechanism and mud pressure penetration mechanism, in a tenth step 400.

If an optimum drilling mud design, whereby the mud pressure penetration mechanism is fully counteracted by the chemical potential mechanism, is not feasible (e.g. without the use of excessively high KCl concentration, which could be detrimental to argillaceous formations through high cation exchange resulting in excessive shrinkage and generation of micro-fractures), there will be reduction in effective mud support (overbalance gradient) with time. It will begin to destabilize the wellbore once the reduction exceeds the "buffer" difference between mud weight used and breakout mud weight. Hence, a daily reduction in effective mud support may also be used as a criterion for managing time-dependent wellbore instability.

In an eleventh step 410, the wellbore condition is monitored while drilling and if the formation appears to be deteriorating, the mud weight is required to be increased progressively by the net reduction in effective mud support prior to the next pull out of hole, e.g., wiper trip, so as to replenish the mud support reduction with time. The net mud weight increase equals the total reduction in effective mud support less any mud weight increase since the last pull out of hole. For example, if the last wiper trip was 4 days prior to the next wiper trip, the daily reduction in effective mud support is 0.1 ppg/day and there was 0.1 ppg mud weight increase since the last wiper trip, then the net mud weight increase is only 0.3 ppg.

Indicators of formation deterioration include, but are not limited to:

Consistent increase in drag by more than a predetermined weight, such as more than 5,000 kg, above the actual pick-up or slack-off weight curve (parallel to the theoretical weight curves) within argillaceous sections that have been exposed for more than a predetermined time period, such as 1 day;

Higher fill on bottom than expected upon running back in hole (allowing for settling of cuttings during pull out of hole and run back in hole); and Soft and/or wet cavings texture in comparison with the texture of fresh cuttings (secondary indicator).

Accordingly, a field-based method and computer program product for use in the field have been developed, to assist in the creation and stabilization of a wellbore drilled in argillaceous formations.

Although the present invention has been described with respect to the presently preferred embodiment, it will be appreciated by those skilled in the art that many changes can be made to the method and computer program product to produce similar technique for maintaining time-dependent wellbore instability in argillaceous formations through which a borehole has been drilled. Accordingly, all changes or modifications that come within the meaning and range of equivalency of this invention are to be embraced within their scope.

TABLE 2

| | | | Observed | Calculated Pore Pressure Change After Maximum Exposure Duration (MPa) | | | | Net Mud Weight Reduction | | Hole |
|---|---|---|---|---|---|---|---|---|---|---|
| Depth (m) | Drilling Mud | Drilling Mud Activity | Maximum Exposure Duration (Day) | Mud Pressure Penetration Mechanism | Chemical Potential Mechanism | Total | Mud Weight Used (ppg) | (% of Breakout Mud Weight) | (% of Mud Weight Used) | Enlargement (% of Wellbore Diameter) |
| 3705 | KCL PHPA Glycol | 0.98 | 2 | 7.16 | 1.46 | 8.62 | 10.4 | 18.25 | 18.07 | 20% |
| 3718.5 | KCL PHPA Glycol | 0.98 | 2-4 | 7.48 | 1.37 | 8.85 | 10.45 | 11.60 | 10.58 | No Information |
| 3753.5 | KCL PHPA Glycol | 0.98 | 6 | 7.76 | 1.30 | 9.06 | 10.5 | −0.55 | −0.44 | No Information |
| 3528 | KCL PHPA Glycol | 0.98 | 11 | 7.59 | 1.12 | 8.71 | 10.5 | 6.47 | 5.53 | 14% |
| 3135 | KCL PHPA Glycol | 0.98 | 12 | 3.83 | 1.12 | 4.95 | 10.5 | 7.23 | 6.80 | 13% |
| 3718 | KCL PHPA Glycol | 0.98 | 3 | 9.62 | 1.42 | 11.04 | 11.0 | 12.10 | 10.61 | 10% |
| 2234.5 | KCL PHPA Glycol | 0.98 | 6-7 | 6.03 | 0.61 | 6.64 | 11.0 | 12.21 | 10.71 | 11% |
| 2425.5 | KCL PHPA Glycol | 0.98 | 6-7 | 6.60 | 0.61 | 7.21 | 11.0 | 12.04 | 10.54 | 7% |
| 3741.5 | KCL PHPA Glycol | 0.98 | 2-3 | 9.76 | 1.42 | 11.18 | 11.0 | 22.83 | 22.75 | 5% |
| 3797 | KCL PHPA Glycol | 0.98 | 6-7 | 10.43 | 1.23 | 11.66 | 11.05 | 20.93 | 20.21 | 13% |

We claim:

1. A method of minimizing pore pressure increase near the wellbore wall within argillaceous formations through which a borehole has been drilled, the method comprising:

extracting and interpreting relevant drilling data related to wellbore instability mechanisms;

delineating, using a processor of a computer, the type, extent and time-dependency of the wellbore instability mechanisms;

determining, using the processor, the impact on drilling mud designs on the time-dependent wellbore instability and hole enlargement;

determining, using the processor, pore pressure change near the wellbore wall after maximum exposure duration due to a mud pressure penetration mechanism and a chemical potential mechanism, wherein the mud pressure penetration mechanism induces an osmotic outflow to be greater than an osmotic inflow, and wherein the chemical potential mechanism induces a difference in salt concentration related to the osmotic outflow from one of the argillaceous formations;

determining, using the processor, at least one field-based criterion relationship between net mud weight reduction percentage ratio and hole enlargement;

determining, using the processor, a maximum allowable percentage ratio(s) of net mud weight reduction and either breakout mud weight used for the adopted maximum hole enlargement that the wellbore may experience during drilling;

determining, using the processor, drilling mud salinity and salt type to satisfy the maximum allowable percentage ratio(s);

monitoring, using the processor, a wellbore condition comprising the drilling mud salinity, the salt type, and the maximum allowable percentage ratio(s) while drilling in the borehole; and adjusting, using the processor, a mud weight based on a change in the wellbore condition to minimize the pore pressure increase and to prevent the one of the argillaceous formations from deteriorating.

2. The method according to claim 1, wherein the drilling data corresponds to drilling experience data.

3. The method according to claim 2, further comprising the step of assembling the drilling experience data into a useable format.

4. The method according to claim 3, wherein the useable format comprises a drilling summary plot.

5. The method according to claim 1, wherein the step of determining the impact of drilling mud designs on the time-dependent wellbore instability and hole enlargement comprises:

performing laboratory measurements in order to determine a range of petrophysical and chemical properties of the argillaceous formation and the properties of the drilling muds of differing mud salinity and salt type; and performing back-analysis for each of the observed time-dependent wellbore instability events.

6. The method according to claim 5, wherein the step of performing back-analysis comprises:

adding the pore pressure change due to mud pressure penetration mechanism and the pore pressure change due to chemical potential mechanism to obtain a net pore pressure change.

7. The method according to claim 1, further comprising, prior to the step of determining pore pressure change near the wellbore wall:

performing cuttings integrity tests; and checking the correlated formation properties for consistency based on information obtained from the cuttings integrity tests.

8. The method according to claim 1, wherein determining the drilling mud salinity and salt type required to satisfy an adopted hole enlargement comprises:

determining at least one field-based criterion relationship or designing drilling mud for maintaining time-dependent wellbore stability by back-analyzing the observed time-dependent wellbore instability events;

determining the maximum allowable percentage ratio(s) of net mud weight reduction and either breakout mud weight or mud weight for the adopted maximum hole enlargement that the wellbore may experience during drilling; and determining the corresponding pore pressure change near the wellbore wall due to the chemical potential mechanism and mud pressure penetration mechanism.

9. The method according to claim 1, further comprising the steps of:

drilling a well using a drilling mud containing salinity and salt type required to satisfy the adopted hole enlargement; and monitoring the wellbore condition of the well while the well is being drilled.

10. The method according to claim 9, wherein when the monitoring step determines a deteriorating wellbore condition, the method comprises the step of:

progressively increasing the mud weight prior to the next pull out of hole or wiper trip to replenish mud support reduction with time.

11. A computer program product embodied in computer readable media and configured to minimize pore pressure increase near the wellbore wall within argillaceous formations through which a borehole has been drilled, the computer program product, when executed on a computer, causing the computer to perform the steps of:

extracting and interpreting relevant drilling data related to wellbore instability mechanisms;

delineating the type, extent and time-dependency of the wellbore instability mechanisms;

determining the impact on drilling mud designs on the time-dependent wellbore instability and hole enlargement;

determining pore pressure change near the wellbore wall after maximum exposure duration due to a mud pressure penetration mechanism and a chemical potential mechanisms wherein the mud pressure penetration mechanism induces an osmotic outflow to be greater than an osmotic inflow, and wherein the chemical potential mechanism induces a difference in salt concentration related to the osmotic outflow from one of the argillaceous formations;

determining at least one field-based criterion relationship between net mud weight reduction percentage ratio and hole enlargement;

determining a maximum allowable percentage ratio(s) of net mud weight reduction and either breakout mud weight or mud weight used for the adopted maximum hole enlargement that the wellbore may experience during drilling;

determining drilling mud salinity and salt type to satisfy the maximum allowable percentage ratio(s);

monitoring a wellbore condition comprising the drilling mud salinity, the salt type, and the maximum allowable percentage ratio(s) while drilling in the borehole; and adjusting a mud weight based on a change in the wellbore condition to minimize the pore pressure increase and to prevent the one of the argillaceous formations from deteriorating.

12. The computer program product according to claim 11, wherein the drilling data corresponds to drilling experience data.

13. The computer program product according to claim 12, further comprising the step of:

assembling the drilling experience data into a useable format.

14. The computer program product according to claim 13, wherein the useable format comprises a drilling summary plot.

15. The computer program product according to claim 11, wherein the step of determining the impact of drilling mud designs on the time-dependent wellbore instability and hole enlargement comprises:

performing laboratory measurements in order to determine a range of petrophysical and chemical properties of the argillaceous formation and the properties of the drilling muds of differing values of mud salinity and salt type that can be used during drilling of the well; and performing back-analysis for each of the observed time-dependent wellbore instability events.

16. The computer program product according to claim 15, wherein the step of performing back-analysis comprises:

adding the pore pressure change due to mud pressure penetration mechanism and the pore pressure change due to chemical potential mechanism to obtain a net pore pressure change.

17. The computer program product according to claim 11, further comprising, prior to the step of determining pore pressure change near the wellbore wall:

performing cuttings integrity tests; and checking the correlated formation properties for consistency based on information obtained from the cuttings integrity tests.

18. The computer program product according to claim 11, wherein determining the drilling mud salinity and salt type required to satisfy an adopted hole enlargement comprises:

determining at least one field-based criterion relationship for designing drilling mud for maintaining time-dependent wellbore stability by back-analyzing the observed time-dependent wellbore instability events;

determining the maximum allowable percentage ratio(s) of net mud weight reduction and either breakout mud weight or mud weight for the adopted maximum hole enlargement that the wellbore may experience during drilling; and determining the corresponding pore pressure change near the wellbore wall due to the chemical potential mechanism and mud pressure penetration mechanism.

19. The computer program product according to claim 11, further comprising the step of:

drilling a well using a drilling mud containing salinity and salt type required to satisfy the adopted hole enlargement; and monitoring the wellbore condition of the well while the well is being drilled.

20. The computer program product according to claim 19, wherein, when the monitoring step determines a deteriorating wellbore condition of the well, the method comprises the step of:

progressively increasing the mud weight prior to the next pull out of hole or wiper trip to replenish mud support reduction with time.

* * * * *